US005518145A

United States Patent [19]

Chen

[11] Patent Number: 5,518,145

[45] Date of Patent: May 21, 1996

[54] GLUE INJECTOR AND THE PROCESS OF INJECTION

[76] Inventor: Hsi H. Chen, No.2, Lane 1, Alley 36, Kuo-Kuan St., Chung-Ho City, Taipei Hsien, Taiwan

[21] Appl. No.: 302,490

[22] Filed: Sep. 12, 1994

[51] Int. Cl.[6] ..... B67D 5/42

[52] U.S. Cl. ..... 222/1; 222/389

[58] Field of Search ..... 222/389, 394, 222/399, 386, 1; 184/39; 169/6–8, 33, 44, 78, 83

[56] References Cited

U.S. PATENT DOCUMENTS

| | | | |
|---|---|---|---|
| 3,367,545 | 2/1968 | Cook | 222/389 |
| 3,405,845 | 10/1968 | Cook et al. | 222/389 X |
| 3,430,731 | 3/1969 | Satzinger | 222/389 X |
| 3,842,939 | 10/1974 | Satzinger | 222/389 X |
| 4,744,442 | 5/1988 | Bras et al. | 222/389 X |
| 5,035,351 | 6/1991 | Moran | 222/389 X |
| 5,234,140 | 8/1993 | Demarest | 222/394 |
| 5,386,883 | 2/1995 | Graf | 222/389 X |

FOREIGN PATENT DOCUMENTS

| | | | |
|---|---|---|---|
| 0085274 | 4/1991 | Japan | 222/389 |
| 0124585 | 5/1991 | Japan | 222/389 |
| 0124586 | 5/1991 | Japan | 222/389 |
| 0111279 | 5/1991 | Japan | 222/389 |
| 0111278 | 5/1991 | Japan | 222/389 |
| 3-162273 | 7/1991 | Japan | 222/389 |

*Primary Examiner*—Kevin P. Shaver
*Attorney, Agent, or Firm*—Larson and Taylor

[57] ABSTRACT

The present invention relates to a glue injector for repairing the cracks on concrete and the process of injection, especially in that the glue in the injector is pushed by the gaseous pressure of carbon dioxide produced by the reaction of chemical decomposition into the crack of concrete. An aqueous solution of citric acid is arranged in the pressure chamber on the top of the injector in this invention, a sodium bicarbonate tablet is placed into the pressure chamber through the aperture thereon, and carbon dioxide gas is gradually released by the reaction of chemical decomposition caused by mixing these two media. The increasing gaseous pressure is used to push the piston in the injector, and push the glue in front of the piston into the crack.

9 Claims, 8 Drawing Sheets

FIG. 11 (A) PRIOR ART

FIG. 11 (B) PRIOR ART

FIG. 11 (C) PRIOR ART

GLUE INJECTOR AND THE PROCESS OF INJECTION

FIELD OF INVENTION

The present invention relates to a glue injector for repairing the cracks on concrete and the process of injection. Sufficient aqueous solution of citric acid is placed inside the pressure chamber on the top of the injector, the sodium bicarbonate tablet is pushed into the chamber through the slot thereon when it is operated, and the gas of carbon dioxide is gradually released from the reaction of chemical decomposition caused by mixing these two ingredients. The piston in the injector with an airtight connection is pushed by the gas of increasing pressure so that the epoxy resin glue in front of the piston is pushed into the crack.

DESCRIPTION OF THE PRIOR ART

Generally speaking, for over forty years cracks in a concrete structure have been prepared with epoxy resin glue and several commonly used methods of filling a crack with the glue is compared as follows:

(1) As illustrated in FIG. 11(A) a manually operated injector is disclosed. Such operation takes more time to repair a small crack and the quality is difficult to control because of the manual operation.

(2) As shown in FIG. 11(B) a pneumatically operated injector uses air pressure from an air compressor to inject the glue. Although such operation provides enough air pressure, it is uneconomical that each machine set repairs only one portion of the crack at a time and the quantity of the glue used to fill the crack is difficult to be exactly controlled.

(3) As illustrated in FIG. 11(C), there is an injector having glue in a rubber container which uses the elasticity thereof after it is filled with the glue to inject it, and as illustrated in FIG. 11(D), the elasticity of elongated rubber bands hung on both sides of a syringe which constrict and inject the glue. Although the quantity of the glue used is under control and the full crack is repaired by both methods described here, it is impossible to precisely control the quality.

The reason is as follows:

The crack on the concrete structure is wider on the surface and narrower on the bottom, so the deeper the glue reaches, the more resistant caused by the viscosity the glue has and, from the viewpoint of mechanics and practical situation, it needs a greater pressure to fill the crack. The pressure produced both by the constriction of the intumescent rubber and the elasticity of the rubber bands is gradually reduced from beginning to end and it does not satisfy the demand for a greater pressure at the end of filling a crack. The glue is difficult to be pushed into the deep portion of the crack, so it leads to an uneven quality of repair.

SUMMARY OF THE INVENTION

In view of the foregoing description, the inventor of this invention developed an injector which uses carbon dioxide gradually produced by the reaction of chemical decomposition in a pressure chamber on the top of the injector as a source to guarantee the quality of repair by the increasing pressure from the beginning of the reaction to the end for stably filling the deep portion of the crack with the glue.

Because the injector and the process of this invention are automatic, any manual operation is unnecessary. The entire crack is filled at the same time, so the operation is economical and the quantity of the glue can be exactly controlled by the scales on the tube.

BRIEF DESCRIPTION OF THE DRAWINGS

FIG. 11(A) is a front elevational view of a conventional injector;

FIG. 11(B) is a front elevational view of another conventional injector;

FIG. 11(C) is a front elevational cross-sectional view of yet another conventional injector;

FIG. 11(D) is a front elevational cross-sectional view of a further conventional injector;

DESCRIPTION OF PREFERRED EMBODIMENTS

Figure 1:
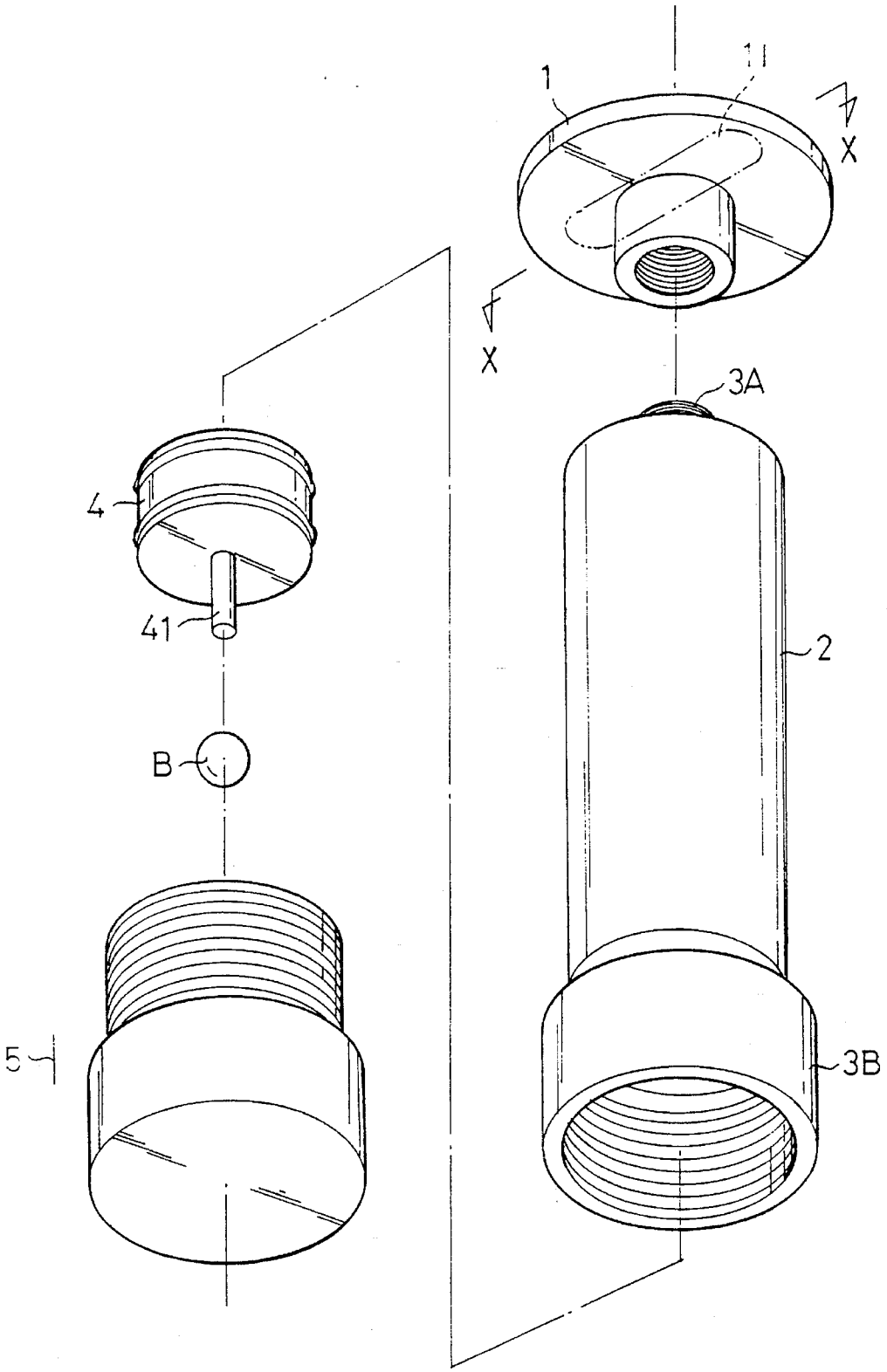
FIG. 1 shows an exploded, perspective view of a glue injector according to the invention.
Figure 3:
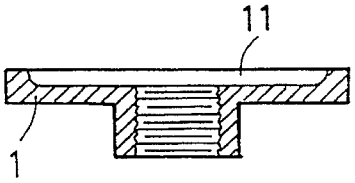
FIG. 3 shows a cross sectional view of the base taken along lines X—X according to FIG. 1.
Figure 4:
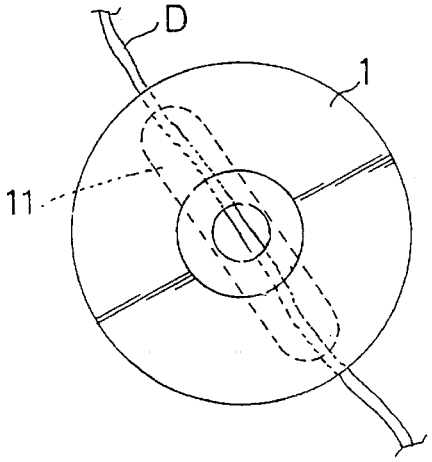
FIG. 4 is a diagram of the base fixed on the crack of the building.
Figure 2:
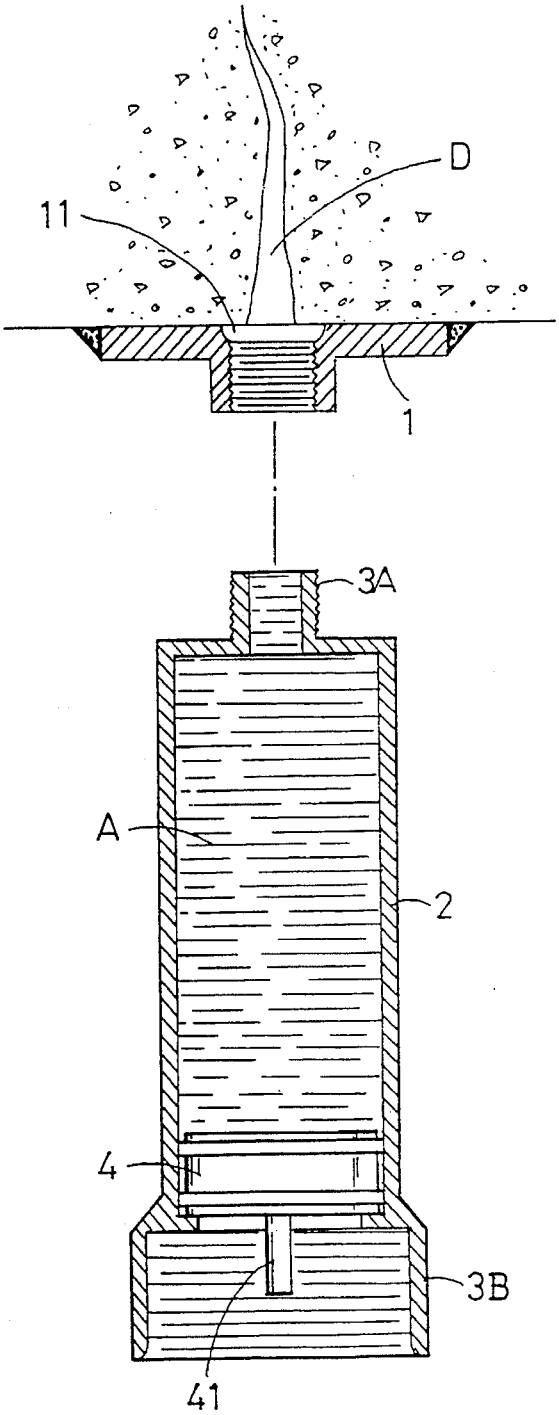
FIG. 2 shows a sectional view of the base and the tube.

FIG. 1 is a perspective view illustrating a preferred injector embodiment in accordance with the present invention, the injector includes a base (1), a tube (2), a piston (4) installed in the tube (2), and a pressure chamber (5). As shown in FIGS. 2 and 3, the base (1) is a disk and has a rectangular injection slot (11) on the bottom, as illustrated in FIG. 4, which is aligned on the crack (D) in the concrete and the circumference of the disk of base (1) is adhered to the concrete with the epoxy resin glue before operation so that the base (1) is fixed on the expected position above the crack (D) in the concrete.

The tube (2) of the injector is a hollow cylinder with a volume of 60 cc, as shown in FIG. 2, and has a bottom threaded part (3A) and a top threaded part (3B), which are defined on the bottom and top respectively. A slidable piston (4) is engaged inside tube (2). A rod (41) having a proper length is installed on one axial side (faced to the top threaded part (3B)) of the piston (4) and is extended inside the top threaded part (3B) when the piston (4) is at the top position of the tube (2).

Enough epoxy resin glue (A) is easily placed into the tube (2) from the bottom threaded part (3A) because the inside of the tube (2) is under normal pressure, then tube (2) is screwed on base (1).

Figure 5:
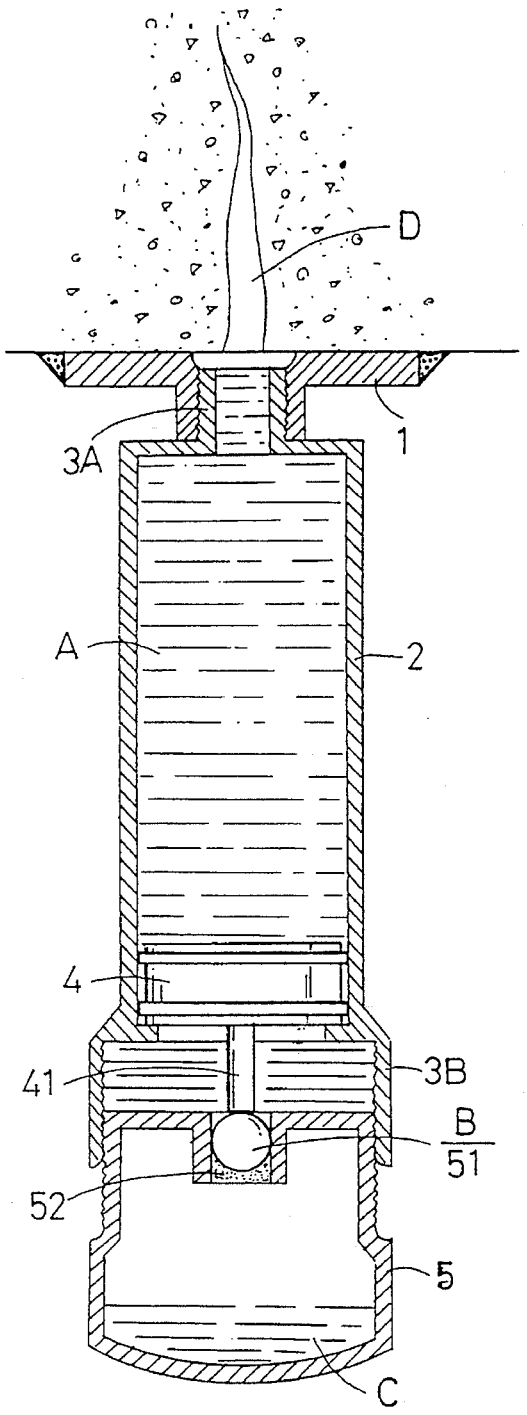
FIG. 5 shows the initial condition of the pressure chamber screwed on the top thread part of the tube.

As shown also in FIG. 5, the pressure chamber (5) is a hollow container with threads which can be screwed on the top threaded part (3B). A washer (52) is used to keep an airtight connection between them. The aperture (51) of the pressure chamber (5) is a one-way tunnel so as to prevent the liquid in the pressure chamber (5) from flowing outside. The aqueous solution of citric acid (C) having a proper concentration is located in the pressure chamber (5), and a sodium bicarbonate tablet (B) is located in the aperture (51). Pressure chamber (5) is screwed on the tube (2).

In accordance with the construct elements in the figures including the base (1), the tube (2), the piston (4), and the pressure chamber (5), the operation of this invention is described hereinbelow.

At first, as shown in FIG. 4, the rectangular injection slot (11) on the base (1) is aligned on the crack (D) of concrete in advance, and the base (1) disk is adhered to the concrete with an epoxy resin glue. As such, it is fixed above the crack of the concrete.

Therefore, as shown in FIG. 2, the piston (4) is moved to the top of the tube (2), and sufficient epoxy resin glue (A) is easily placed into the tube (2) from the bottom threaded part (3A) because the inside of tube (2) is under normal pressure.

Then, as shown in FIG. 5, the tube (2) filled with the epoxy resin glue (A) is screwed on the base (1) by the thread of the bottom threaded part (3A) on it.

Figure 6:
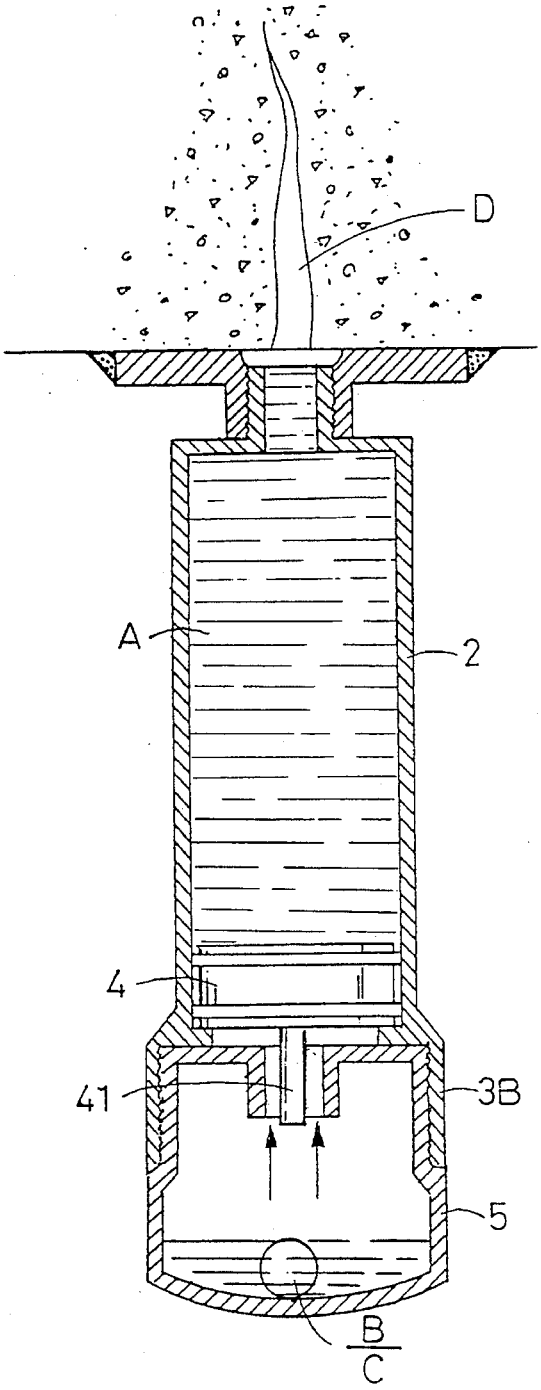
FIG. 6 shows the pressure chamber of FIG. 5 screwed on the top thread part of the tube.

After the foregoing procedure is completed, as illustrated in FIGS. 5 and 6, a sodium bicarbonate tablet (B) is placed in the aperture (51), the pressure chamber (5) is filled with an amount of an aqueous solution of citric acid, and the pressure chamber (5) is screwed tightly on the top thread part (3B) of the tube (2).

As the pressure chamber (5) is screwed on, the sodium bicarbonate tablet is pushed by the stick (41) of the piston (4) and drops into the pressure chamber (5) from the aperture (51) thereof. It then mixes with the aqueous solution of citric acid and a reaction of chemical decomposition occurs with the gas of carbon dioxide being gradually produced.

Figure 7:
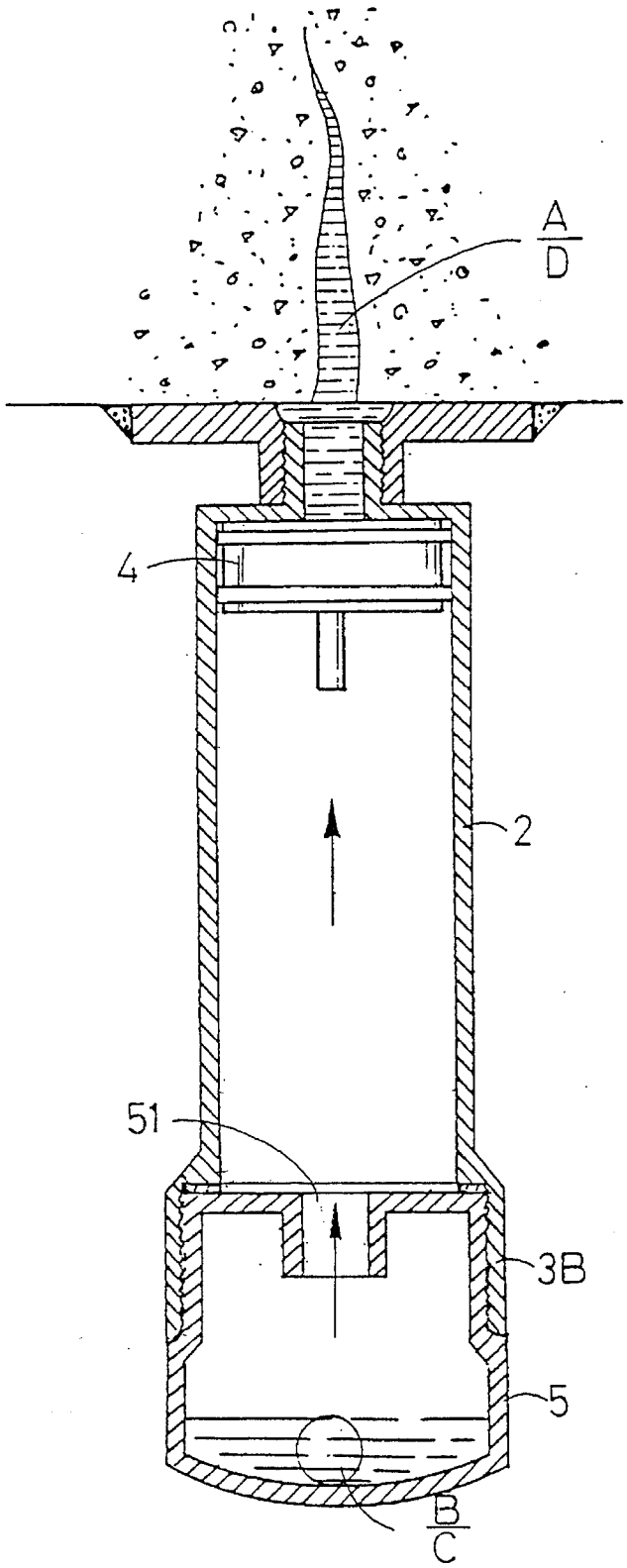
FIG. 7 shows the piston of FIG. 6 pushed to the bottom of the tube by gaseous pressure.

The chemical reaction continuously delivers the gas of carbon dioxide, and the pressure of the sealed pressure chamber (5) gradually increases. The increasing air pressure pushes the piston (4) toward the base (1) and simultaneously pushes the liquid epoxy resin glue (A) located in front of the piston (4) into the crack through the injection slot (11) on the base (1), as shown in FIG. 7.

Owing to the different dimensions of concrete structures (the dimensions of a bridge buttress and dam are larger, but the dimensions of a girder in a resident building is smaller), the pressure required for repairing the crack on the concrete is different. The method of adjusting the amount of pressure in the injector of this invention is to adjust the quantities of the sodium bicarbonate tablet and the aqueous solution of citric acid in order to obtain the expected pressure.

According to the description of page 2292 in THE MERCK INDEX published in 1983, citric acid is a chemical compound containing one crystalline water, the solubility to water is 60% in room temperature and it is a weak acid. In page 8408 of this publication, sodium bicarbonate is described as a white crystal, and partially decomposes to release carbon dioxide gas in 50° C. Its aqueous solution is unstable and has a decomposition reaction to slowly generate carbon dioxide gas in 20° C., and the reaction is accelerated if a weak acid exists.

According to the design of this invention, the aqueous solution of citric acid with a concentration of 50% (1.5 g of citric acid+1.5 g of water) is arranged inside the pressure chamber (5) in advance. When operating, a sodium bicarbonate ($NaHCO_3$) tablet (B) is placed in the aperture (51) and by mixing it with the citric acid it causes a reaction of chemical decomposition, so as to gradually release the gas of carbon dioxide.

The equation of chemical reaction is as follows:

$$3NaHCO_3 + HO_2CCH_2C(OH)(CO_2H)CH_2CO_2H.H_2O \xrightarrow{H_2O} NaO_2CCH_2C(OH)(CO_2Na)CH_2CO_2NA + 4H_2O + 3CO_2\uparrow$$

Theoretically, according to the equation of the chemical reaction, and assuming the 1.2 g of sodium bicarbonate tablet and the aqueous solution of citric acid react completely, from the calculation of ideal gas equation in 25° C., about 4 atmosphere pressureS of carbon dioxide will be produced in the tube (80 ml) of the injector.

For a further understanding about the pressure and the temperature variation versus time and temperature, and the viscosity variation versus time during the hardening time of the epoxy resin glue in practical operation of this invention, three experiments are described below:

EXAMPLE 1

Pressure variation during the chemical reaction in the injector (constant volume)

Steps (1) Weight out 1.5 g of citric acid containing one crystalline water and 1.5 g of aqua destillata, and place them into the 17 ml of pressure chamber and uniformly mix them.

(2) Push the piston with 7.0 $cm^2$ of cross section to the top of the tube in advance.

(3) Weigh out 1.2 g of sodium bicarbonate tablet and throw it into the pressure chamber.

(4) Screw the pressure chamber on the tube quickly and make an airtight connection.

(5) Connect the injector with an airtight connection to a pressure gauge.

Result

Figure 8:
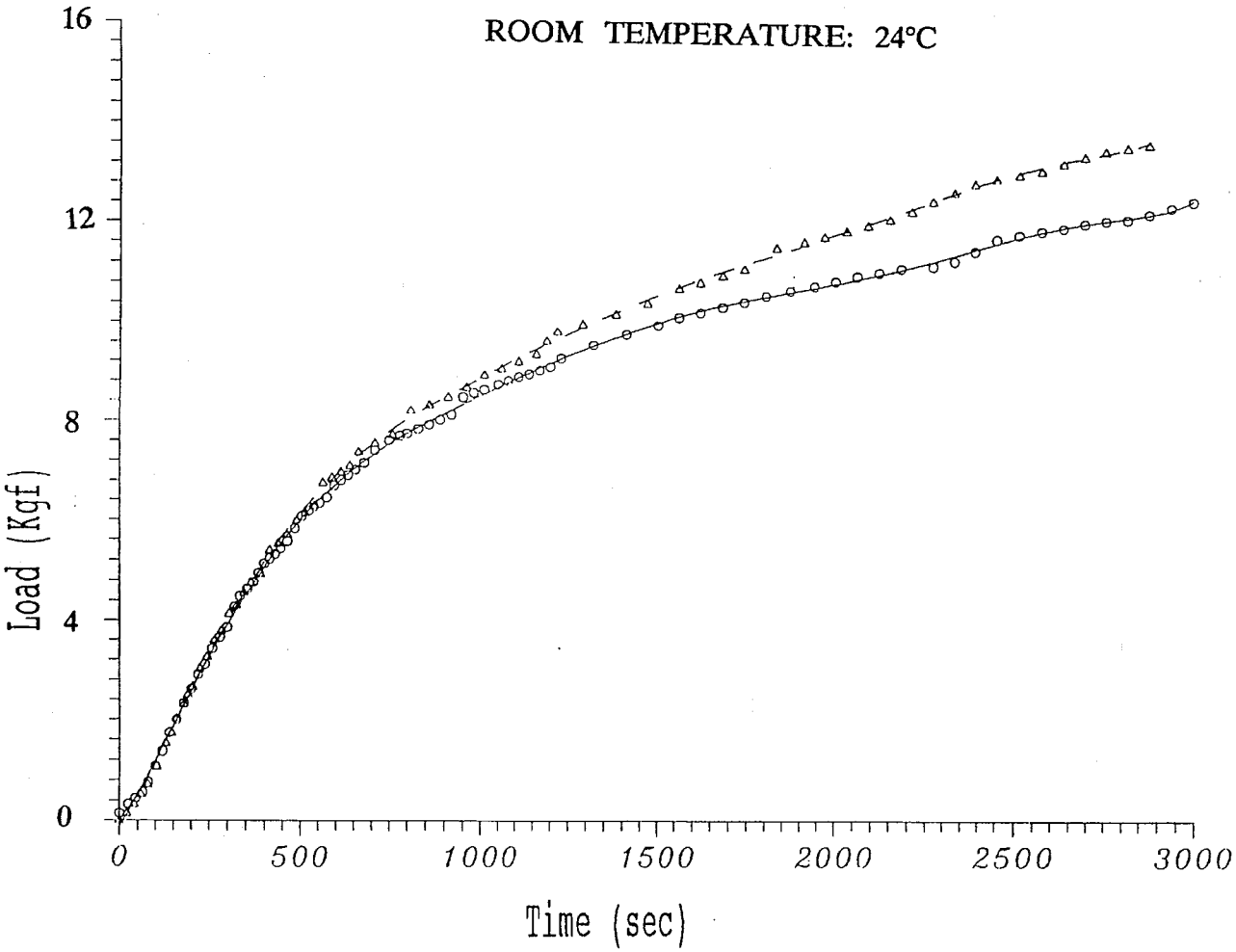
FIG. 8 shows the curve of pressure variation versus time during the chemical reaction in the injector.

The gas of carbon dioxide released by the reaction of chemical decomposition caused by mixing the aqueous solution of citric acid and the sodium bicarbonate in the pressure chamber increases the pressure inside the injector. The digits from the display screen of the pressure gauge were recorded every 5 seconds for 50 minutes and a diagram, as shown in FIG. 8 depicts the result. The abscissa is time (SEC) and the ordinate is load (kgf). The maximum load is about 12.5–13.8 kgf at the fiftieth minute (translating to pressure :1.8–2.0 $kgf/cm^2$).

EXAMPLE 2

The temperature variation during the chemical reaction in the injector (constant volume)

Steps (1) Weigh out 1.5 g of citric acid containing one crystalline water and 1.5 g of aqua destillata, and place them into the 17 ml of pressure chamber and uniformly mix them.

(2) Push the piston with 7.0 $cm^2$ of cross area to the top of the tube in advance.

(3) Weigh out 1.2 g of sodium bicarbonate tablet and throw it into the pressure chamber, place a thermometer in the tube and put the other one in the pressure chamber through the aperture, then screw the pressure chamber on the tube tightly and quickly.

Result

Figure 9:
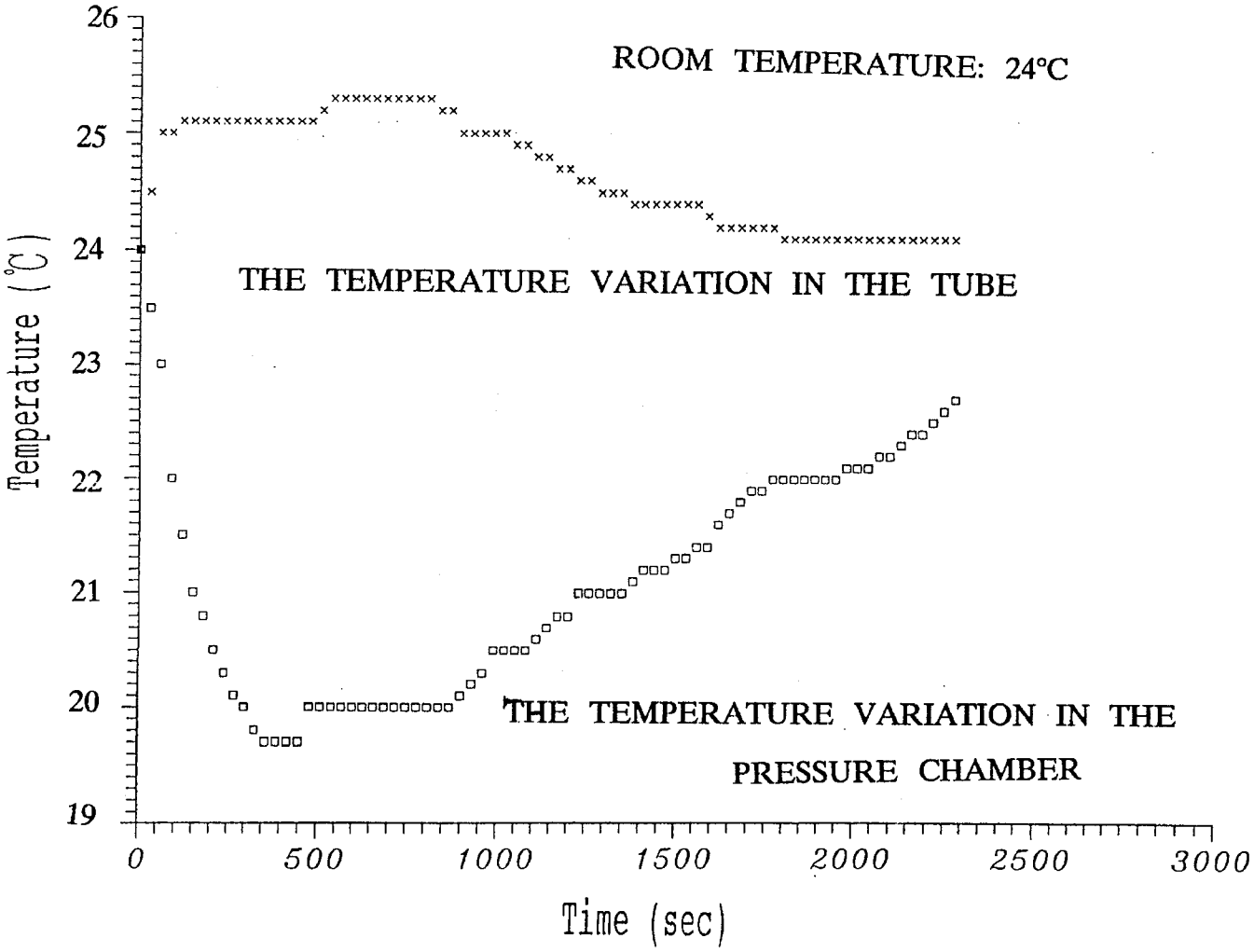
FIG. 9 shows the curve of temperature variation versus time during the chemical reaction in the injector.

The chemical reaction caused by mixing the aqueous solution of citric acid and the sodium bicarbonate in the pressure chamber is an exothermic reaction. Theoretically, it increases the temperature of the pressure chamber, but the vaporization of the carbon dioxide released by the reaction of chemical decomposition carries the heat away, transferring it to the tube, and then finally attains a heat balance with the outside under room temperature. The temperature is recorded every 5 seconds, and it is found that first the temperature in the pressure chamber drops to 19.7° C. from the initial 24° C., and then rises slowly to room temperature. On the other hand, the temperature in the tube first rises to 25.5° C. from room temperature and then drops to room temperature again. The total recording time is 50 minutes. A diagram in which the abscissa is time (SEC) and the ordinate is temperature (° C.) is shown in FIG. 9.

EXAMPLE 3

The viscosity and temperature variation versus time during the hardening time of the double type epoxy resin glue.

Steps (1) Weigh out 106 g of epoxy resin and 53 g of hardener (B) and mix them equably and place them into a 180 ml beaker.

(2) Use the Mettler-RM180 dynamic viscometer and choose the No. 3 rotary probe, setting the shear rate to 1000 on the instrument, and start it to rotate the probe.

(3) The temperature (° C.) and the viscosity (Pa.s) is displayed on the screen of the instrument and recorded automatically.

Results

Figure 10:
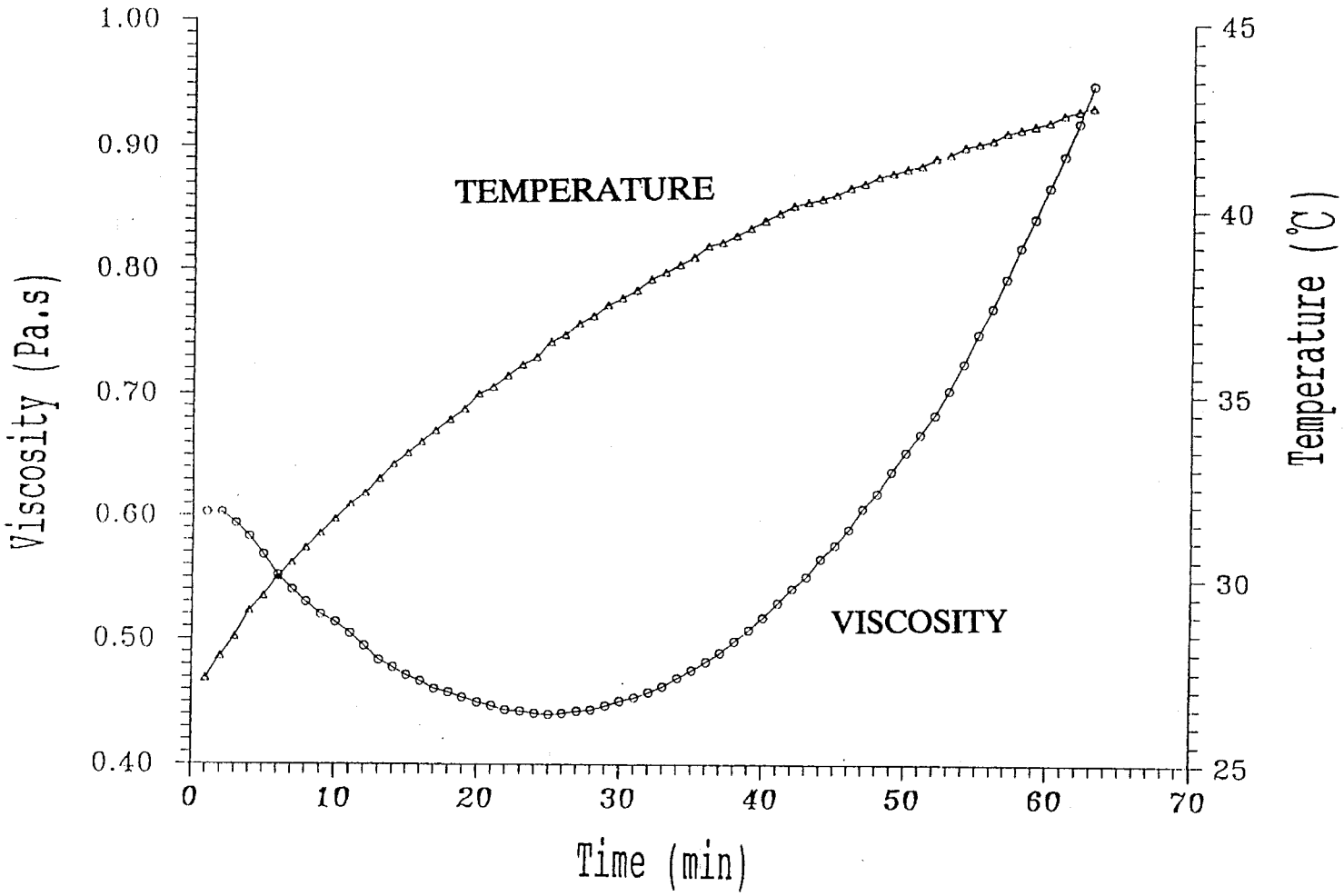
FIG. 10 shows the curves of viscosity and temperature variation in the hardened time of the epoxy resin.
Figure 11:
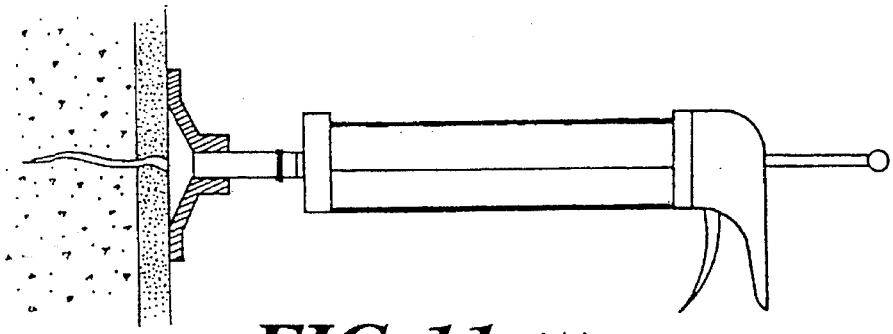
FIG. 11 (D) PRIOR ART
FIG. 11 is an indication diagram of some conventional injectors.
Figure 11:
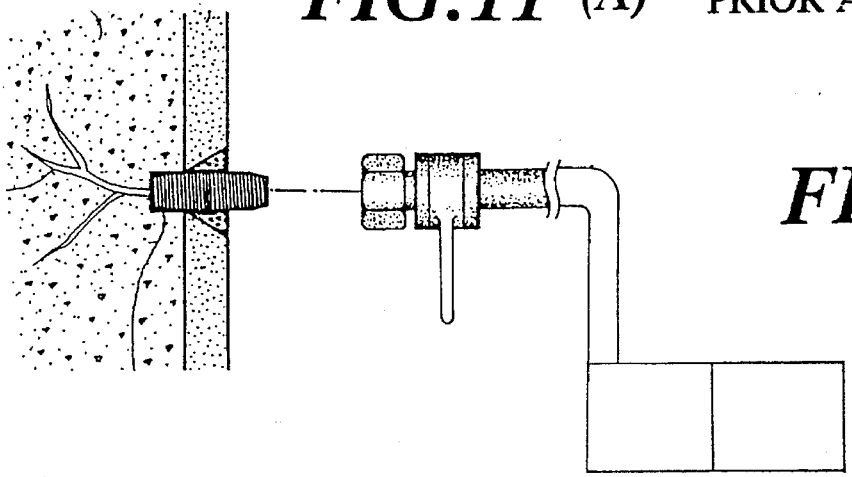
FIG. 11 (D) PRIOR ART
Figure 11:
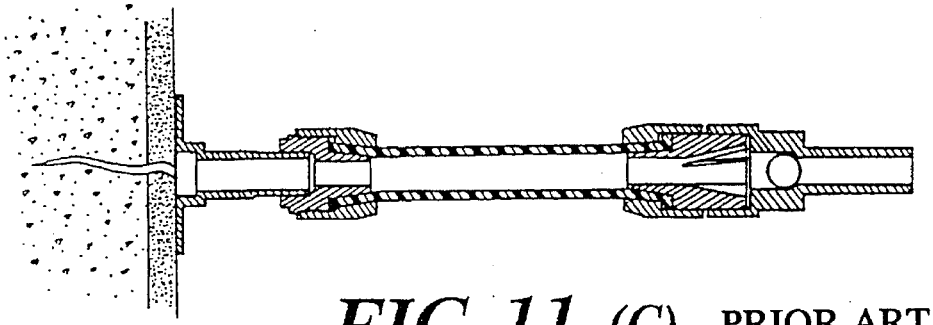
FIG. 11 (D) PRIOR ART
Figure 11:
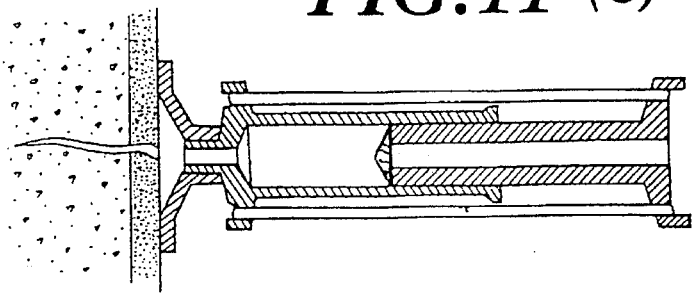
FIG. 11 (D) PRIOR ART

The double type epoxy resin glue is used by mixing the epoxy resin (A) and the hardener (B) in a weight ratio of 2:1, and it is an exothermic reaction. The initial temperature and viscosity is 27.3° C. and 0.603 Pa.s respectively, the temperature gradually rising but the viscosity falling within the first 26 minutes. At the twenty-sixth minute the temperature is 36.4° C. but the viscosity is 0.440 Pa.s which is the minimum. Thereafter, both the temperature and viscosity gradually rise, and, at the sixty-third minute, the temperature and the viscosity are 42.8° C. and 0.95 Pa.s respectively, as illustrated in FIG. 10.

Conclusion of the Experiments

1. The gas pressure of carbon dioxide produced by the reaction of chemical decomposition caused by mixing the sodium bicarbonate and the aqueous solution of citric acid in the injector is gradually and stably increasing. From the variation curve of pressure versus reaction time, it shows: (area of piston=7.0 $cm^2$)

a. The initial pressure of reaction is 0.

b. After 5 minutes of reaction, the maximum load is 3.5 kgf (pressure=0.5 $kgf/cm^2$).

c. After 12 minutes of reaction, the maximum load is 7.0 kgf (pressure=1 $kgf/cm^2$).

d. After 30 minutes of reaction, the maximum load is 10.5 kgf (pressure=1.5 $kgf/cm^2$).

e. After 50 minutes of reaction, the maximum load is 13 kgf (pressure=1.85 $kgf/cm^2$).

Thus it is realized that the pressure behavior during the operation of this invention satisfies the required increasing pressure needed to push the glue into the deep portion of the crack.

2. The gas of carbon dioxide released by the reaction of chemical decomposition caused by mixing the sodium bicarbonate and the aqueous solution bring the heat away from the pressure chamber and into the tube. According to the variation curve of temperature versus time we know:

a. The initial temperature of the reaction is 24° C.

b. After 1 minute of reaction, the gas carries the heat into the tube makes the space temperature thereof increase by 0.5° C.

c. After 4 minutes of reaction, the gas carrying the heat into the tube makes the space temperature thereof increase by 1° C.

d. After 12 minutes of reaction, the gas carrying the heat into the tube makes the space temperature thereof increase by 1.5° C. (after 13 minutes of reaction, the increasing rate of the pressure is gradually slowing).

e. After 16 minutes of reaction, the gas carrying the heat into the tube makes the space temperature thereof increase by 1° C. (has a climate of falling).

f. After 20 minutes of reaction, the gas carrying the heat into the tube makes the space temperature thereof increase by 0.5° C. (keep falling).

g. After 30 minutes of reaction, the gas carrying the heat into the tube makes the space temperature thereof increase by 0.2° C. (keep falling).

h. After 50 minutes of reaction, the gas carrying the heat into the tube makes the space temperature thereof increase by 0.1° C. (keep falling).

Thus it is realized that the heat inside the tube is passed to the outside environment and gradually the temperature reaches an equilibrium with the outside temperature.

3. From example 3, during the hardening time of the epoxy resin, the temperature rises from 27.3° C. to 42.8° C. in an hour, and the variation of viscosity falls during the first 26 minutes. Then, both the viscosity and the temperature rise after 26 minutes of reaction. After 1 one hour of observation, the viscosity is about 0.95 Pa.s, which is still within the usable range. The heat which causes a small temperature variation (1.5° C.) in a short time and is carried into the tube by the gas of carbon dioxide has no or only a slight influence on the physical characteristic of the epoxy resin glue during the process of repair.

Summarizing the foregoing description, from the result of deductions from scientific instrument testing, and practical operation, it is concluded that the piston is pushed stably by the reaction of chemical decomposition caused by mixing the sodium bicarbonate and the aqueous solution of citric acid in the pressure chamber, which in turn pushes the liquid epoxy resin glue in front of the piston into the crack, and thus achieving the purpose of repairing the crack in the concrete.

What is claimed is:

1. A method of injecting glue comprising the steps of providing an injector with a cylinder having a first closed end with an opening therein through which glue can pass and a second end, and a piston slideably mounted inside said cylinder, said piston having a first side that is spaced from said first cylinder end and a second side that faces said cylinder second end;

adding a glue to said spacing between said opening and said piston;

placing an aqueous solution of citric acid in fluid communication with said cylinder second end;

adding a sodium bicarbonate tablet to said aqueous solution of citric acid, thereby generating a gas from the reaction of chemical decomposition and increasing the pressure on said piston second side, whereby said pressure forces said piston toward said cylinder first end and results in glue being forced out of said cylinder opening in said first end thereof.

2. The method of injecting glue as claimed in claim 1 wherein said aqueous solution of citric acid is a solution of citric acid dissolved in water.

3. The method of injecting glue as claimed in claim 1 wherein said sodium bicarbonate tablet is made by reprocessing and compressing sodium bicarbonate powder.

4. The method of injecting glue as claimed in claim 1 and further including:

fixedly mounting a base onto a wall having a crack therein, said base having means for being attached to said cylinder first end in a fluid tight relationship with said cylinder; and attaching said cylinder to fixed base.

5. The method of injecting glue as claimed in claim 4 wherein said cylinder second end includes means for attaching a pressure chamber in a fluid tight relationship with said cylinder;

and wherein said step of placing an aqueous solution of citric acid includes placing said citric acid in said pressure chamber and attaching said pressure chamber to said cylinder second end.

6. The method of injecting glue as claimed in claim 4 wherein said piston second side has a rod coaxially mounted at said second side; and wherein said pressure chamber includes an open end and a tunnel open at opposite sides and mounted in said pressure chamber open end such that it is in axial alignment with said rod;

and wherein said step of placing an aqueous solution of citric acid in fluid communication with said cylinder second end comprises placing said solution of citric acid inside said pressure chamber;

said method further comprising placing said sodium bicarbonate tablet in said tunnel; and attaching said pressure chamber to said cylinder second end such that said rod engages said tablet and pushes said tablet into said pressure chamber which contains said solution of citric acid.

7. A glue injector comprising a hollow tube having a first open end and a second open end, said tube capable of containing a glue;

a piston mounted inside said tube and movable from a first position proximate to said first end to a second position proximate to said second end, such that when said piston is moved from said first position toward said second position, any glue contained in said tube can be ejected out of said second open end;

a pressure chamber having a cavity therein and an aperture at an end of said chamber for permitting fluid communication from said cavity, said pressure chamber being removeably mounted to said tube first end at a first position in said tube such that said piston is aligned with said aperture, and said pressure chamber being moveable to a second position in said tube;

an aqueous solution of citric acid in said pressure chamber cavity;

a sodium bicarbonate tablet positioned in said pressure chamber aperture; and means for moving said tablet from said aperture into said solution when said pressure chamber is moved to said second position.

8. The glue injector as claimed in claim 7 wherein said tube first end has threads and wherein said pressure chamber has threads that mate with said tube first end threads such that said pressure chamber can be screwed on said tube; and wherein said tablet moving means comprises a rod mounted at one end of said piston and extending axially inside said tube toward said first end, said rod engaging said tablet and pushing said tablet into said pressure chamber cavity, and thus into said aqueous solution, as said pressure chamber is screwed from said tube first position to said tube second position.

9. The glue injector as claimed in claim 7 and further including a base having an orifice therein, said base being mountable over a crack or opening that is to be filled with glue, said base having means by which said tube second end can be attached thereto in a fluid tight relationship; and wherein said tube second end includes means for mating with said base attaching means in a fluid tight relationship such that glue contained in said tube can be emitted through said base orifice.

* * * * *